US006202935B1

(12) United States Patent
Akkala et al.

(10) Patent No.: US 6,202,935 B1
(45) Date of Patent: Mar. 20, 2001

(54) COMBINED POTABLE WATER HEATER AND HYDRONIC HEATING SYSTEM

(75) Inventors: Marc W. Akkala, Cedarburg; Jill M. Szczech, Cudahy; Frank A. Mueller, Hales Corners; Dennis R. Hughes, Harford; Kevin M. Field, Oconomowoc; Ray O. Knoeppel, Hartland, all of WI (US); Timothy J. Bodnar, Mansfield, OH (US)

(73) Assignee: AOS Holding Company, Wilmington, DE (US)

( * ) Notice: Subject to any disclaimer, the term of this patent is extended or adjusted under 35 U.S.C. 154(b) by 0 days.

(21) Appl. No.: 09/290,951

(22) Filed: Apr. 13, 1999

Related U.S. Application Data

(60) Provisional application No. 60/081,859, filed on Apr. 15, 1998.

(51) Int. Cl.[7] ..... F24D 3/08

(52) U.S. Cl. ..... 237/19; 165/57

(58) Field of Search ..... 237/19, 8 R; 236/20 R, 236/21 B, 22; 165/57

(56) References Cited

U.S. PATENT DOCUMENTS

| | | | | |
|---|---|---|---|---|
| 3,896,992 | | 7/1975 | Borovina et al. | 237/19 |
| 4,210,102 | | 7/1980 | Dosmann | 122/20 |
| 4,241,588 | | 12/1980 | Murphy et al. | 62/238 |
| 4,401,261 | * | 8/1983 | Brown | 236/10 |
| 4,406,402 | | 9/1983 | Henriques | 237/19 |
| 4,483,310 | * | 11/1984 | Kelly | 126/35 |
| 4,699,091 | | 10/1987 | Waters | 122/20 |
| 4,745,757 | | 5/1988 | Kim | 60/667 |
| 4,821,682 | | 4/1989 | Waters | 122/20 |
| 4,823,770 | * | 4/1989 | Loeffler | 126/362 |
| 4,978,063 | * | 12/1990 | Chase | 237/8 R |
| 5,020,721 | * | 6/1991 | Horne | 236/20 R |
| 5,372,185 | * | 12/1994 | Lannes | 165/70 |
| 5,432,710 | | 7/1995 | Ishimaru et al. | 364/493 |
| 5,485,879 | * | 1/1996 | Lannes | 165/70 |
| 5,758,820 | | 6/1998 | Celorier, Jr. et al. | 237/2 |

* cited by examiner

*Primary Examiner*—Harold Joyce
*Assistant Examiner*—Derek S. Boles
(74) *Attorney, Agent, or Firm*—Michael Best & Friedrich LLP

(57) ABSTRACT

A combined potable water heater and hydronic heating system including:

a water tank for holding hydronic heating water;

a flue extending through the tank;

a burner below the flue so that heat and exhaust gases generated by the burner pass through the flue to heat the water in the tank; and a potable water container mounted in the tank so that the hydronic heating water heats the water in the potable water container and so that the hydronic water is separated from the potable water.

31 Claims, 11 Drawing Sheets

10
HEATING OUT
GAS
COLD
MIXED
HEATING IN
300
194
196
198
202
182
P
34
102
98
86
238
234
218
214
244
241
94
90
206
210
110
106
122
220
148
166
162
38
170
174
172
14
22
142
176
30

174
166
170
18
172
14
22
164
158
202
186
162
38
188
190
178
182
198
194
222
86
220
56
238
236
62
58
54
148
244
64
90
235
61
146
226
66
240
63
142
234
218
242
217
65
214
110
210
216
206
124
30
70

COMBINED POTABLE WATER HEATER AND HYDRONIC HEATING SYSTEM

RELATED APPLICATION

This application claims the benefit of U.S. Provisional Patent Application No. 60/081,859, filed Apr. 15, 1998.

BACKGROUND OF THE INVENTION

The invention relates to apparatus for heating potable water and to hydronic heating apparatus.

A conventional residential gas water heater includes a potable water tank, a combustion chamber below the tank, a gas burner in the combustion chamber, and a flue extending upwardly from the combustion chamber and through the tank so that heat from the flue heats water in the tank.

A conventional residential hydronic heating system includes a boiler connected to radiators by pipes.

SUMMARY OF THE INVENTION

The invention provides a combined gas potable water heater and hydronic heating system. The system of the invention includes a conventional gas water heater with a flue extending through a tank, except that hydronic heating water, rather than potable water, is heated in the water tank. Potable water is heated in a heat exchanger or potable water container, preferably a coiled conduit surrounding the flue, inside the tank. Thus, the potable water is heated by the heating water in the tank and is maintained separate from the heating water.

The combined potable water heater and hydronic heating system is preferably contained in a cabinet having a relatively small footprint and is particularly suited for use in apartments or other small living quarters. The system is adaptable to various types of gas, including natural, LP and manufactured. The system is inexpensive to manufacture and is easy to operate and maintain.

The invention also provides a spacer for maintaining the spacing of the coils of the coiled conduit during shipping, the spacer being fixed to the flue.

The invention also provides a special union connecting an end of the coiled conduit inlet with a conduit external of the tank. The special union includes an externally threaded spud mounted on the exterior of the tank, the spud having an outer end with an internal chamfer. The end of the coiled conduit extends through the spud, and the special union also includes a ferrule surrounding the coiled conduit end, and a union member having an inner portion which is threaded onto the spud, which surrounds the ferrule and which has an internal chamfer. The ferrule is compressed between the chamfers so that the ferrule seals around the coiled conduit end and seals against both the spud and the union member, thereby sealing the coiled conduit end relative to the tank. The union member also has an outer portion to which the external conduit is sealingly connected, thereby sealingly connecting the external conduit to the coiled conduit end. The external conduit has an inner diameter greater than the outer diameter of the coiled conduit end so that the coiled conduit end can extend into the external conduit if the coiled conduit end extends beyond the union member.

Other features and advantages of the invention will become apparent to those skilled in the art upon review of the following detailed description, claims, and drawings.

Figure 1:
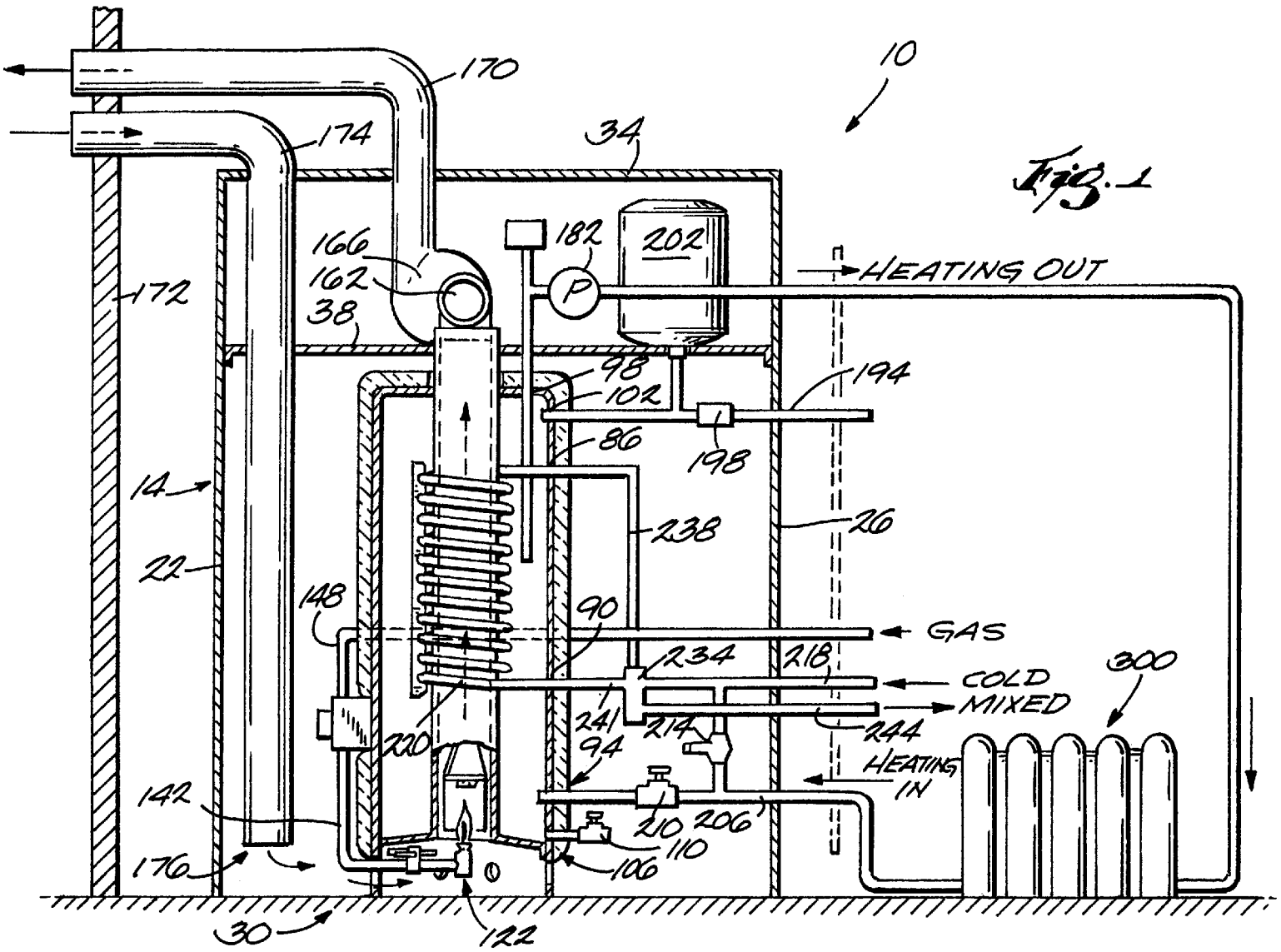
FIG. 1 is a schematic view of an apparatus embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DESCRIPTION OF THE PREFERRED EMBODIMENT

Figure 2:
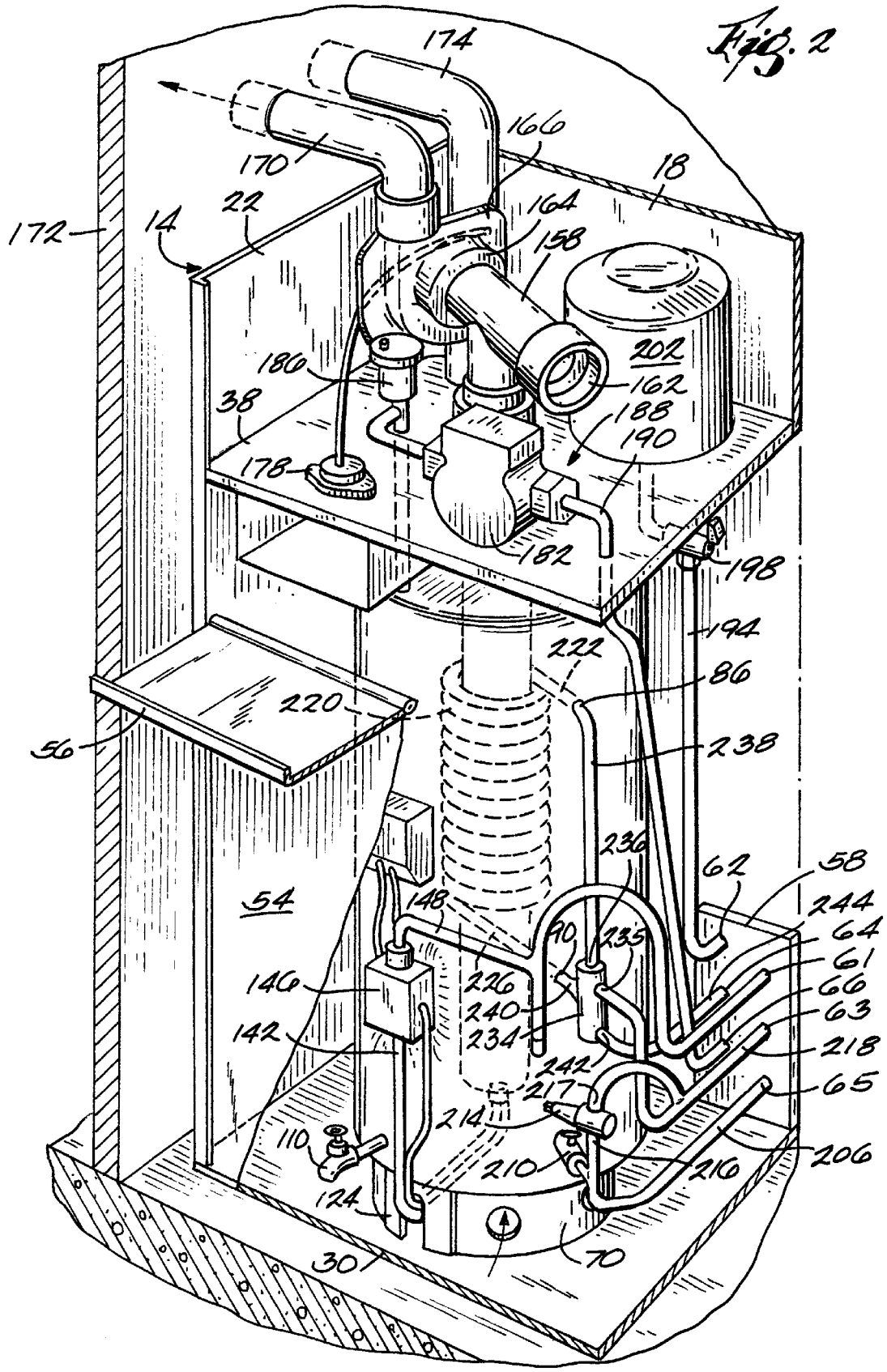
FIG. 2 is a partial perspective view of the apparatus.
Figure 3:
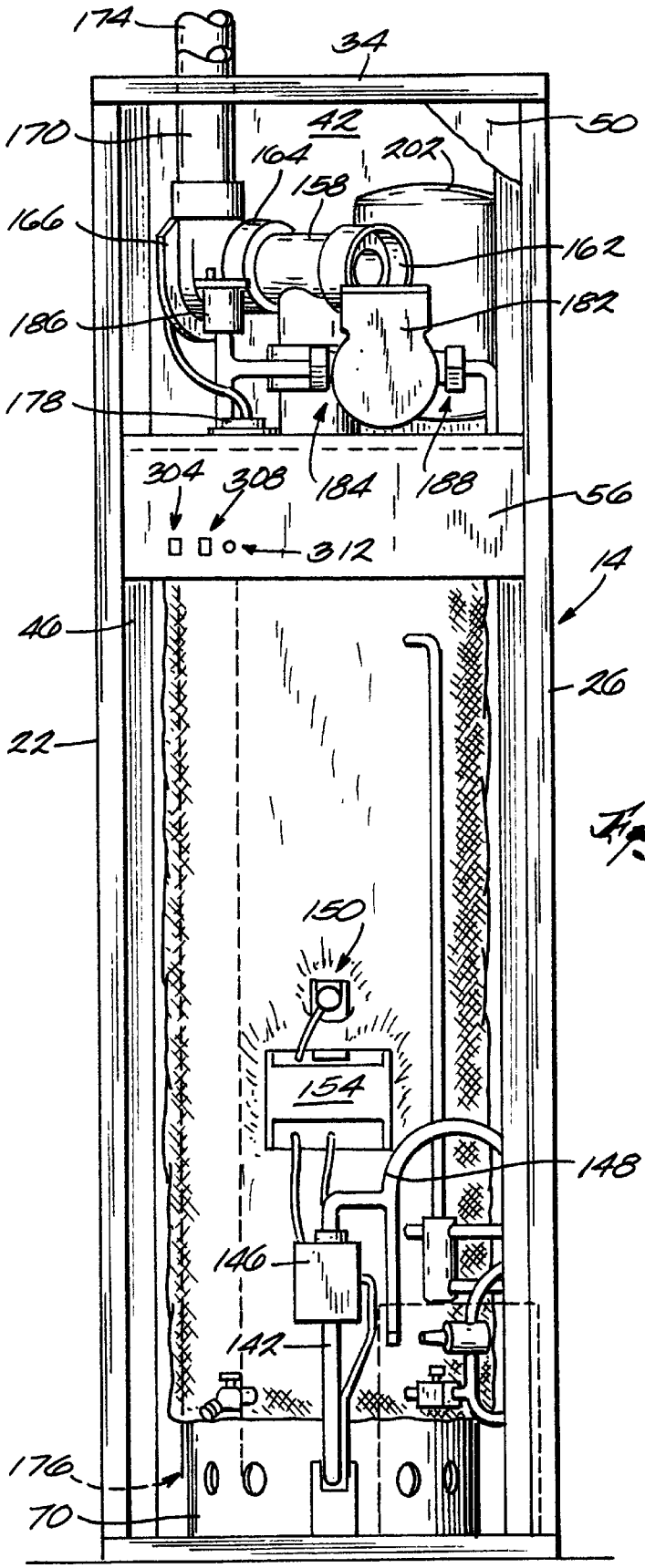
FIG. 3 is a front elevational view of the apparatus with the doors removed.
Figure 4:
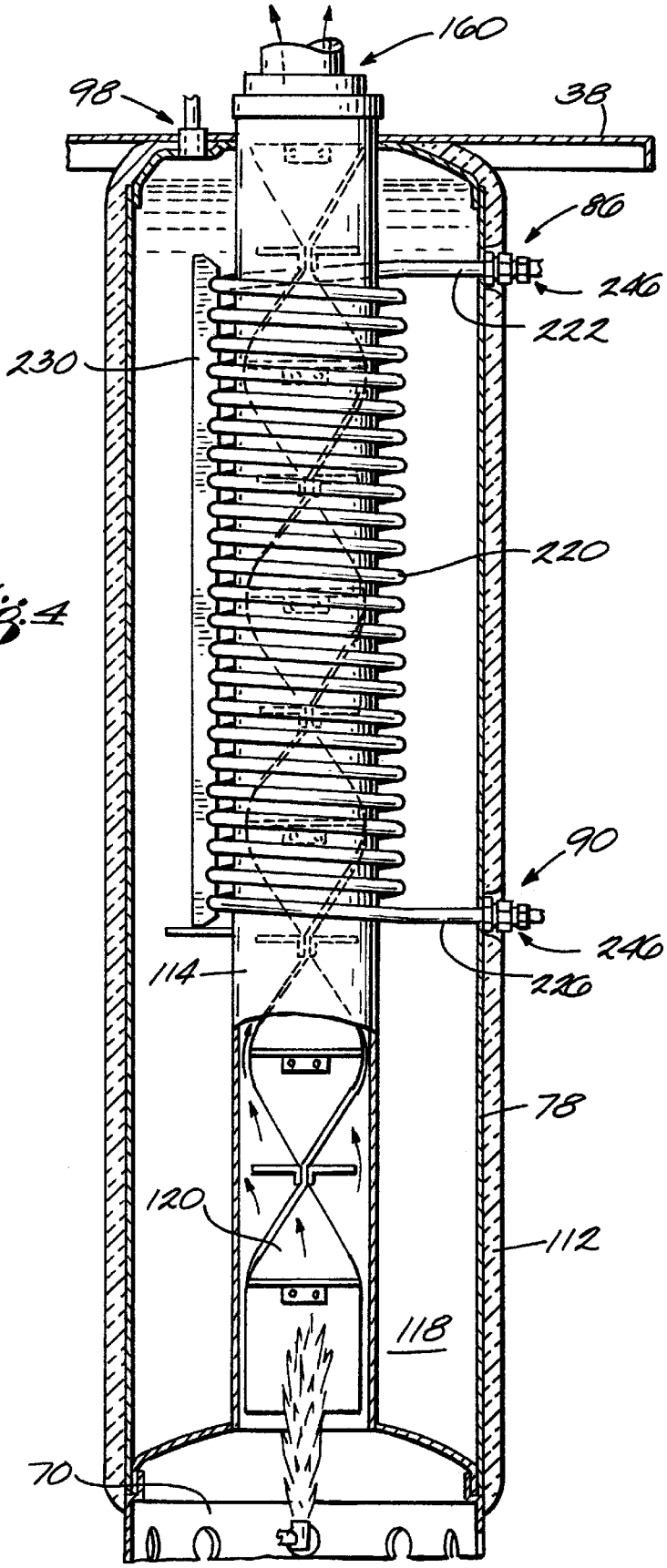
FIG. 4 is a sectional view of the tank.
Figure 5:
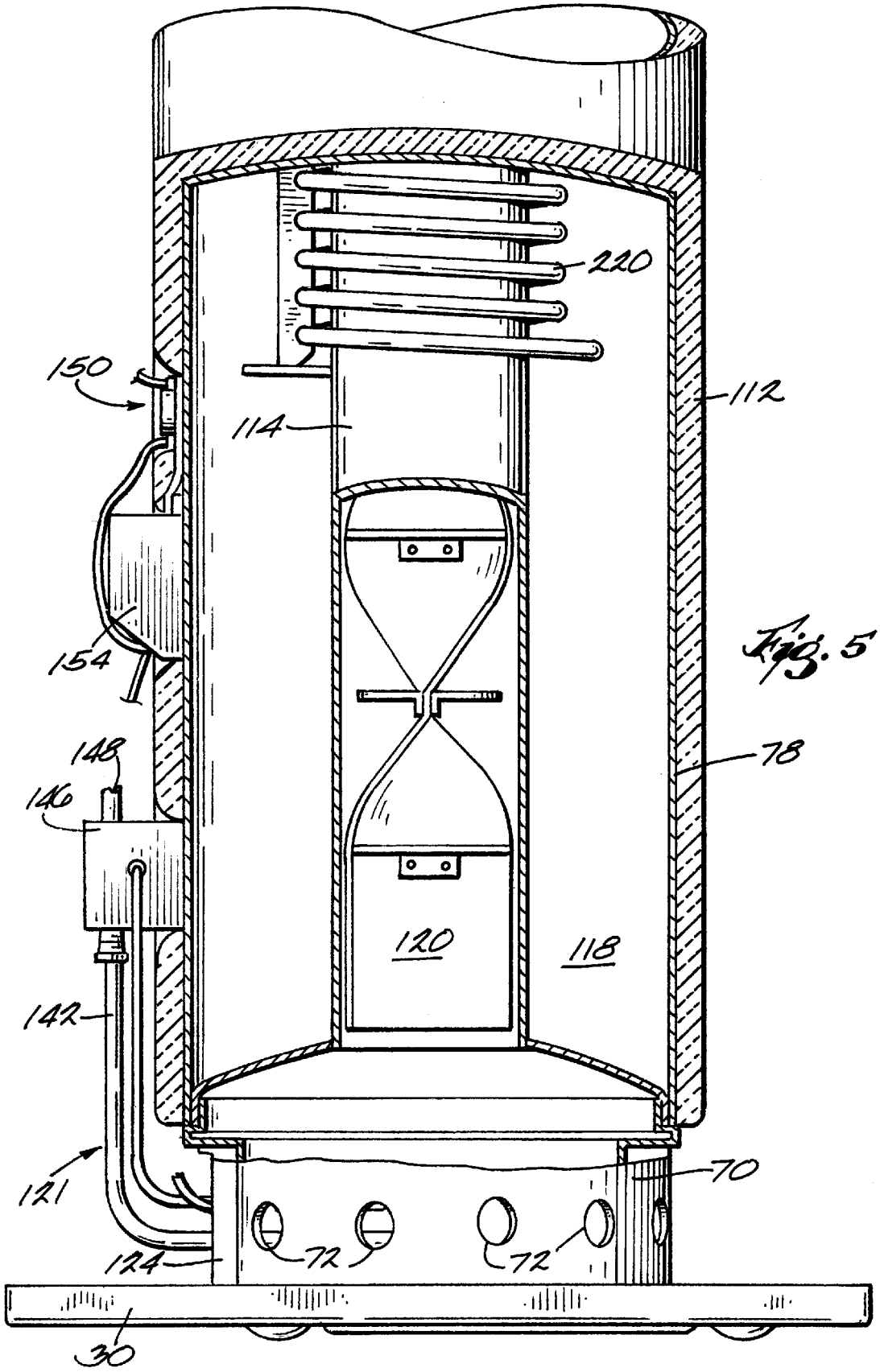
FIG. 5 is an enlarged partial sectional view of the tank.
Figure 7:
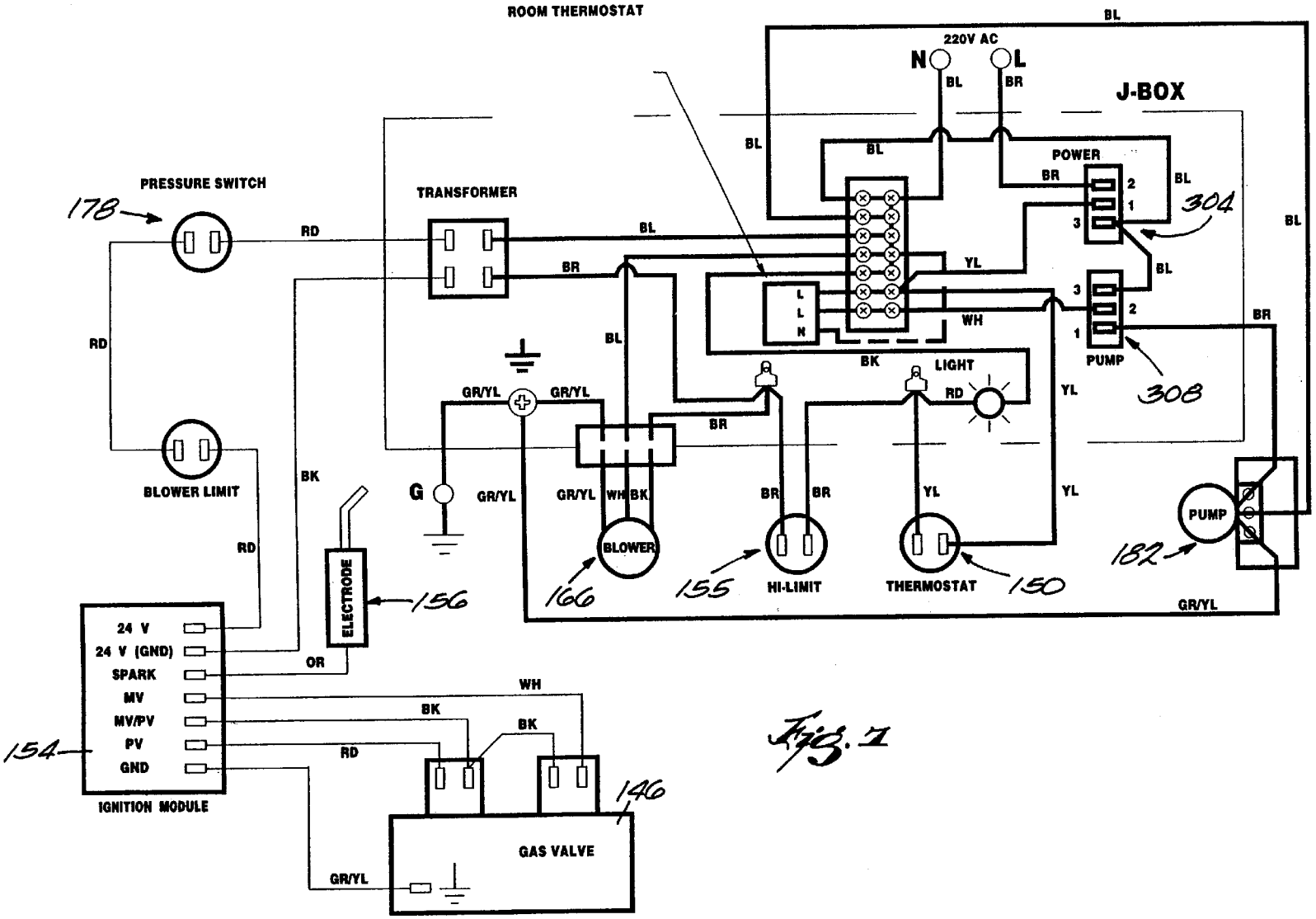
FIG. 7 is an electrical circuit diagram of the apparatus.

An apparatus 10 embodying the invention is shown in FIGS. 1–3. It should be noted that FIG. 1 is not accurate as far the relative positions of and distances between elements of the apparatus 10 but is helpful in understanding the operation of the apparatus 10. The apparatus 10 is a combined potable water heater and hydronic heating system. The apparatus 10 comprises a cabinet 14 including a generally vertical rear wall 18, generally parallel, generally vertical side walls 22 and 26 extending forward from the opposite sides of the rear wall 18, a generally horizontal base 30 extending forward from the bottom of the rear wall 18 and between the side walls 22 and 26, and a generally horizontal top wall 34 extending forward from the top of the rear wall 18 and between the side walls. The cabinet 14 also includes a generally horizontal shelf 38 extending forward from the rear wall 18 and between the side walls 22 and 26 so as to define an upper space 42 between the shelf 38 and the top wall 34 and a lower space 46 between the shelf 38 and the base 30. The cabinet 14 further includes a removable upper door 50 (partially shown in FIG. 3) for closing the front of the upper space 42, and a removable lower door 54 for closing the front of the lower space 46. The cabinet 14 also includes a panel 56 between the doors 50 and 54. The panel 56 pivots down to a generally horizontal position (shown in FIG. 2) to allow access to the inside of the cabinet 14 for servicing the water heater and hydronic heating system, and to act as a shelf upon which the service technician may set tools or parts. Preferably, the circuit diagram shown in FIG. 7 is located on the inner surface of the panel 56 so as to be visible when the panel is pivoted down. The cabinet 14 preferably has a width of approximately 20 inches and a height of approximately 66 inches.

Figure 8:
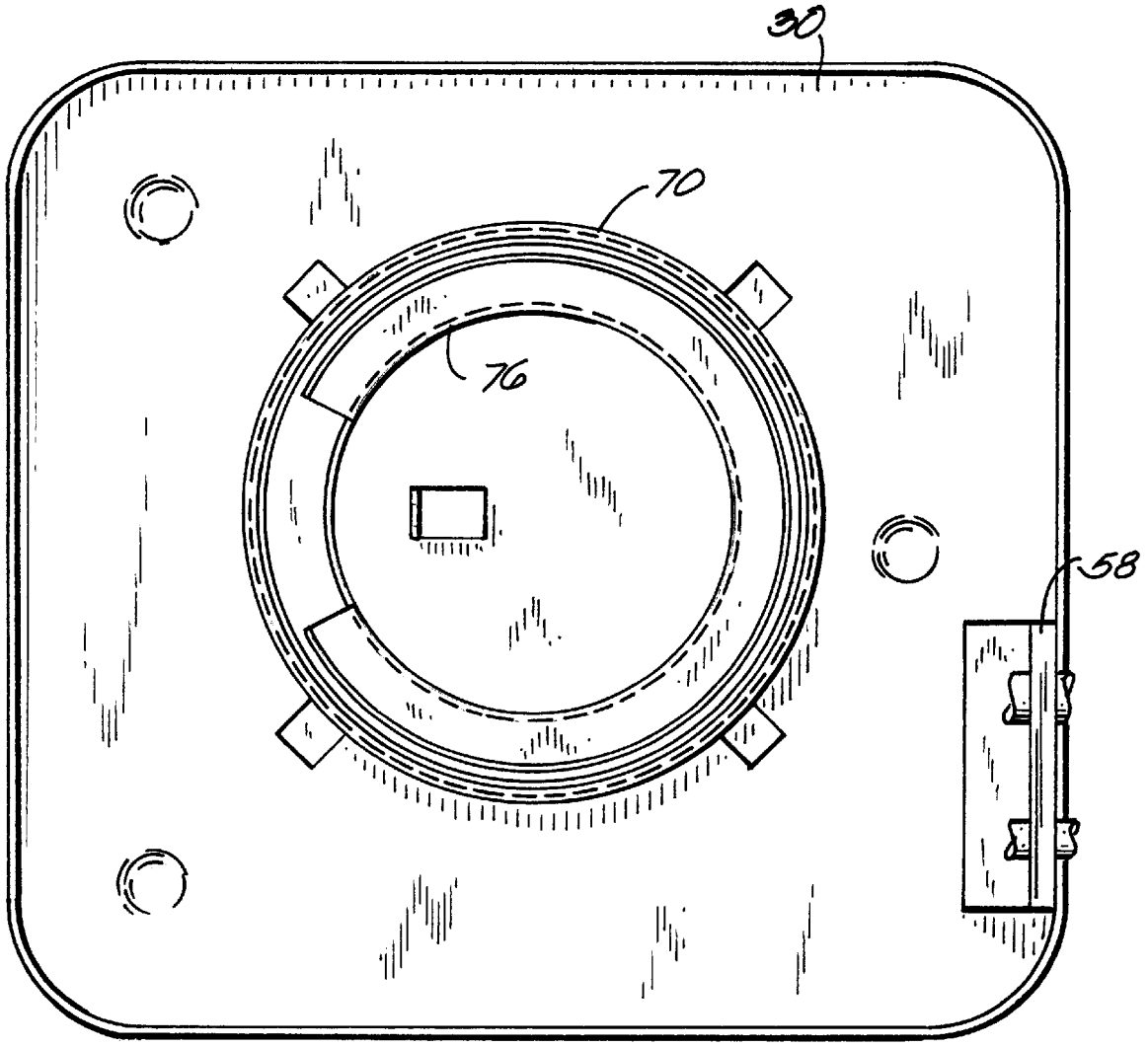
FIG. 8 is a plan view of the cabinet base assembly, including the skirt ring and the header plate.
Figure 9:
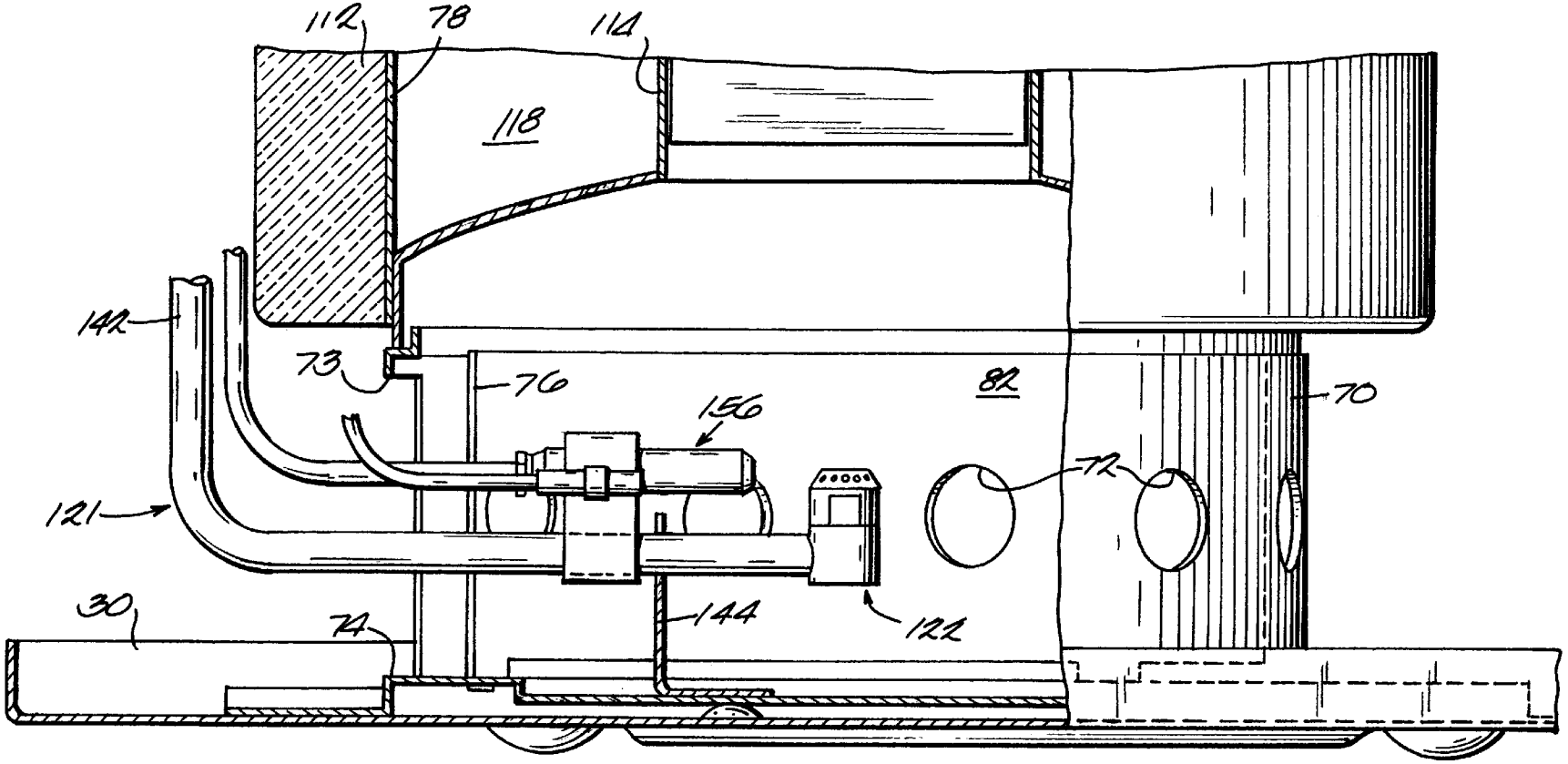
FIG. 9 is an elevational view of the cabinet base assembly and the burner and pilot assembly.

A generally vertical header plate 58 (FIGS. 2 and 8) is fixed to the base 30 inside the rear wall 18 of the cabinet 14. The header plate 58 includes (see FIG. 2) first, second, third, fourth, fifth and sixth water or gas connections 61, 62, 63, 64, 65 and 66, respectively, extending through the rear wall 18 of the cabinet. The first connection 61 is connectable to a source of gas, the second connection 62 is a pressure relief outlet, the third connection 63 is an inlet for potable water, the fourth connection 64 is an outlet for potable water, the fifth connection 65 is an inlet for hydronic heating water, and the sixth connection 66 is an outlet for hydronic heating water. The functions of these connections is explained below.

The apparatus 10 also comprises (see FIGS. 2–5, 8 and 9) a skirt ring 70 fixed generally to the center of the base 30, the skirt ring 70 having therein air inlet openings 72 and an opening through which the burner assembly passes. The skirt ring 70 provides for support of the water heater tank, creates combustion space, provides combustion air openings, and allows access to the burner and combustion space.

A radiation shield 74 (see FIG. 9) sits on the base 30 inside the skirt ring 70. The radiation shield 74 is designed to shield radiant energy from the burner to minimize floor temperatures. It is also dish shaped to collect condensate. Legs can be provided on the bottom of the radiation shield to set the distance off the bottom of the cabinet 14. Combined with the burner locator described below, the shield 74 also sets the height of the burner.

An inner skirt ring 76 is attached to the radiation shield 74. The inner ring 76 is designed to allow air flow over the top and bottom of the ring 76 while preventing radiation through the combustion air openings 72 in the skirt ring 70. This minimizes cabinet temperatures.

A water tank 78 is seated on top of the skirt ring 70 so as to define (see FIG. 9) a burner space 82 below the tank 78 and inside the skirt ring 70. The tank 78 preferably has a height of approximately 48 inches and a diameter of approximately 12 inches. In this appliance the hydronic heating water is stored in the tank 78. Since the heating water is in a closed system, it is "dead" (minimal oxygen) and will cause minimal corrosion to the steel tank. Therefore a glass liner is generally not necessary. The tank 78 includes a potable water inlet 86 (FIG. 4), a potable water outlet 90 (FIG. 4), a hydronic water inlet 94 (FIG. 1), a hydronic water outlet 98 (FIGS. 1 and 4), an expansion tank outlet 102 (FIG. 1), and a drain valve outlet 106 (FIG. 1). A drain valve 110 communicates with the drain valve outlet 106. A 3" thick fiberglass blanket 112 with a vinyl cover preferably insulates the tank 78. This insulation preferably has a nominal insulation factor of R-10.

A generally vertical, generally cylindrical flue 114 extends through the tank 78 so as to define a hydronic water chamber 118 inside the tank 78 and outside the flue 114. The flue 114 preferably has a diameter of approximately five inches. The flue 114 extends through the shelf 38 so that the upper end of the flue 114 is held in place by the shelf 38. The lower end of the flue 114 communicates with the burner space 82. A baffle 120 (see FIGS. 4 and 5) is positioned in the flue 114. The baffle 120 is preferably a twisted tape baffle with tabs welded to each flat location on both sides of the baffle 120. The baffle 120 hangs in a slot on the top of the flue 114. Stainless steel or other high temperature material is recommended for the lower portion of or the entire baffle.

Figure 11:
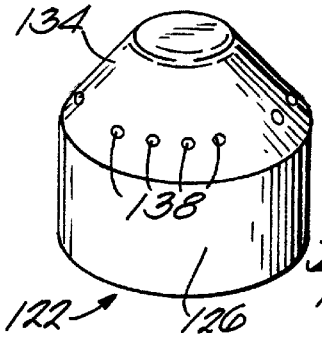
FIG. 11 is a perspective view of a manufactured gas burner.
Figure 16:
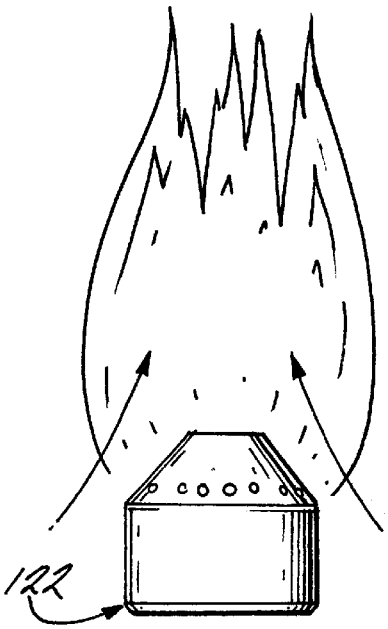
FIG. 16 is a view of the flame profile using the manufactured gas burner.

The apparatus 10 also comprises (see FIGS. 5, 9, 11–13 and 16) a burner assembly 121 including a gas burner 122 located in the burner space 82 below the lower end of the flue 114. The burner assembly 121 passes through the opening 73 in the skirt ring 70, and a burner door 124 (see FIGS. 2 and 5) closes the opening 73. The illustrated burner 122 is particularly suited for use with manufactured gas. The burner 122 has (see FIGS. 11–13) a generally cylindrical portion 126 centered on the center axis of the flue 114, the cylindrical portion 126 having an interior space 130 (FIG. 13). The burner 122 also has a frustoconical portion 134 above the cylindrical portion 126. The frustoconical portion 134 has therein a plurality of outwardly and upwardly angled holes 138 communicating between the interior space 130 and the outer surface of the frustoconical portion 134. The holes 138 are evenly spaced around the frustoconical portion 134 with a gap between holes at every ninety degrees (best shown in FIG. 12). The burner 122 provides a flame that does not, when the burner is operating properly, impinge on any surface outside of the flue 114, e.g., on the bottom of the tank 78 or the bottom head. As shown in FIG. 16, the irregular spacing, i.e., the gaps between holes 138 of the burner 122 allow air to entrain in the center of the burner flame 140. This results in improved mixing of air and fuel, reduced recirculation and head temperature, and reduced carbon build-up on the burner 122.

Figure 12:
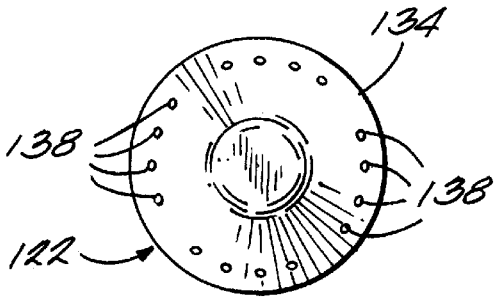
FIG. 12 is plan view of the manufactured gas burner.
Figure 13:
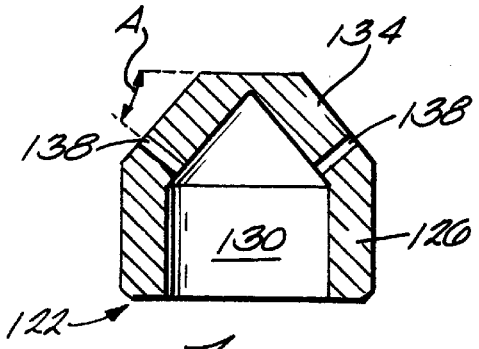
FIG. 13 is a sectional view of the manufactured gas burner.

Referring to FIGS. 12 and 13, several variables affect burner performance. The angle "A" of the holes 138 determines the direction of the gas jets emanating from the burner 122. The orientation of the gas jets changes the shape and size of the flame pattern. Angle "A" can vary from zero to ninety degrees, with the larger angle yielding a smaller flame diameter. At zero degrees, the jets would be horizontal, giving the largest flame pattern. At ninety degrees, the jets would be vertical, giving the smallest flame pattern. In general, angles in the range of thirty to sixty degrees are desired. The number of burner ports 138, in conjunction with the diameter of each port 138, determines the maximum input for a given gas and pressure. These can be varied to alter the way the gas mixes with air for combustion, as well as the shape of the flame. In general, higher gas velocities out of the ports 138 provide better mixing of air with the gas. Port diameter is selected based on the input and number of ports 138. The ports are burr free, and are preferably not chamfered.

Figure 10:
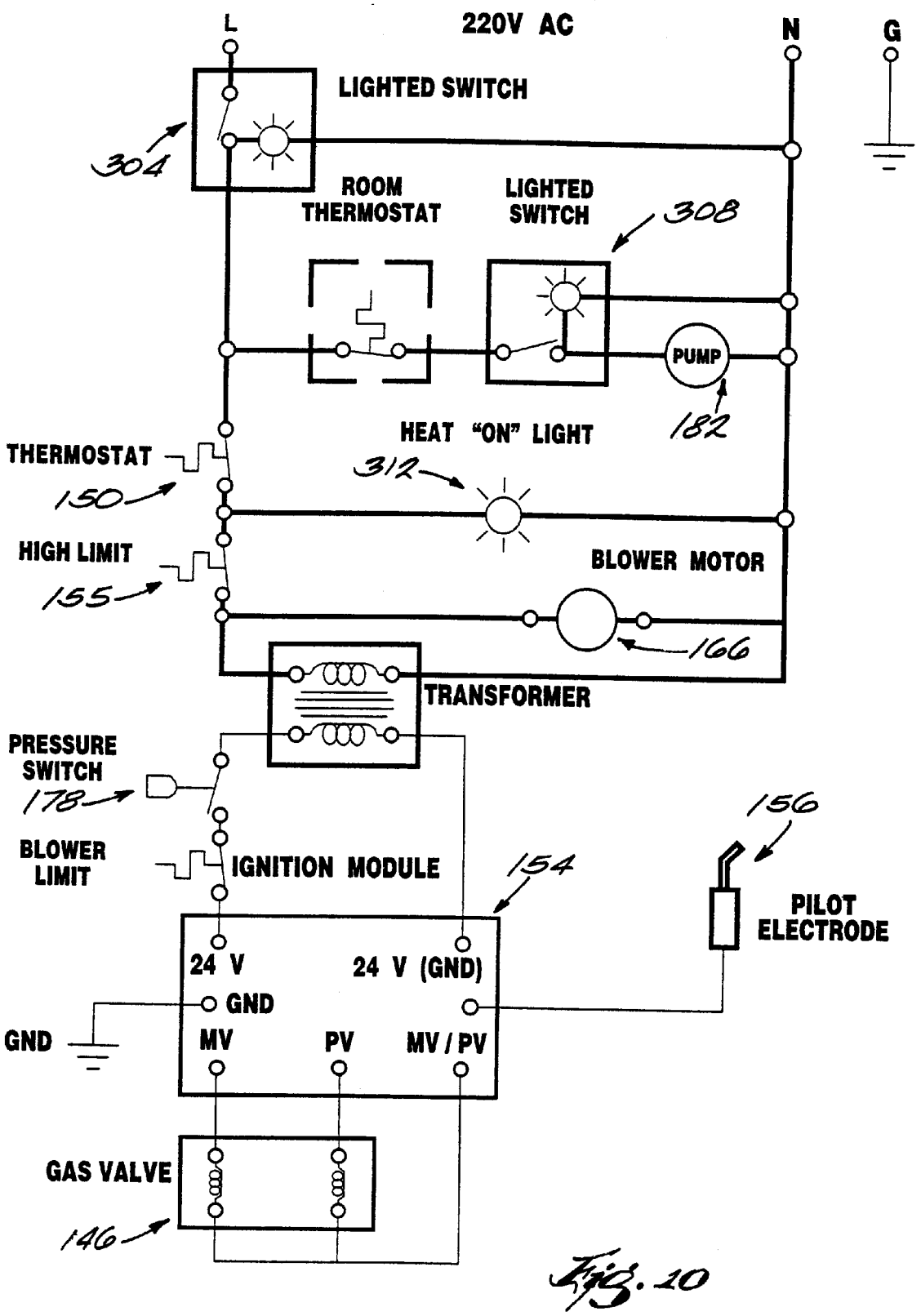
FIG. 10 is an electrical circuit diagram of the apparatus.

The burner assembly 121 also includes (see FIGS. 5 and 9) a gas conduit 142 having an outlet end communicating with the interior space 130 of the burner 122. The gas conduit 142 is supported by a member 144 fixed to the radiation shield 74 so as to fix the burner 122 relative to the flue 114. It is important that the burner 122 be properly positioned so that the flames do not undesirably contact the flue 114. The gas conduit 142 has an inlet end communicating with the source of gas via a gas valve 146, a gas conduit 148, and the first header plate connection 61. The gas valve 146 is preferably manufactured by White Rogers. A thermostat 150 (see FIGS. 3 and 5) is mounted on the exterior of the tank 78 and is operably connected to the gas valve 146 via an ignition module 154. The ignition module 154 is preferably a Honeywell S8600M. The thermostat 150 is preferably set to maintain water temperature at approximately 85° C., which is important for hydronic heating. A manual reset surface mount high limit switch 155 (shown schematically in FIGS. 7 and 10) is preferably located on the side of the tank 78 to control maximum water temperature at 90° C. Upon call for heat from the thermostat, the system powers the pilot valve and initiates spark ignition. After the pilot is lit and flame is sensed, the gas valve 146 is opened.

The burner assembly 121 also includes (see FIG. 9) a pilot electrode assembly 156, which is preferably a Johnson Controls J984DDW. Other pilot configurations could also be used, but should be selected so that they do not affect main burner flames or combustion.

Figure 14:
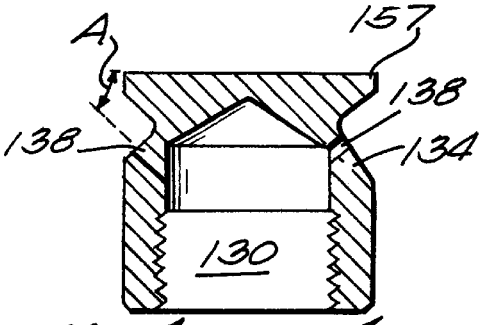
FIG. 14 is a sectional view of a natural gas burner.
Figure 15:
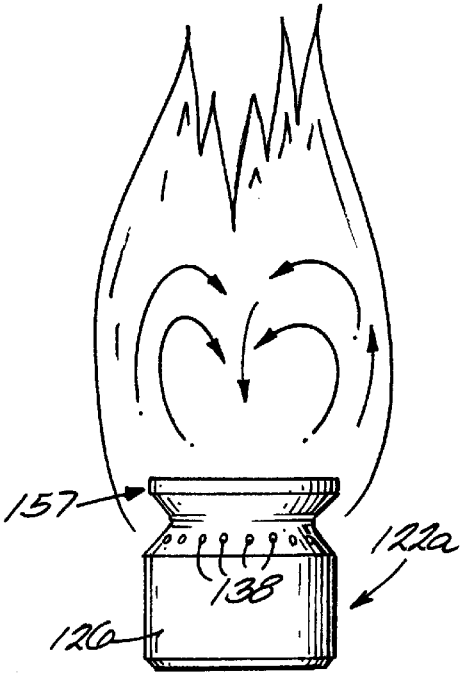
FIG. 15 is a view of the flame profile using the natural gas burner.

A burner 122*a* particularly suited for use with natural gas is shown in FIGS. 14 and 15. The burner 122*a* differs from the burner 122 in the addition of a deflector portion 157 above the holes 138. Otherwise, common elements have been given the same reference numerals.

A T-shaped conduit 158 (see FIGS. 2 and 3) is mounted on the upper end of the flue 114 above the shelf 38. The T-shaped conduit 158 has a lower or flue exhaust inlet 160 (see FIG. 4) communicating with the upper end of the flue 114, an ambient air inlet 162 communicating with the upper space 42, and a mixed flue exhaust/ambient air outlet 164 communicating with the inlet of a blower 166. The inlet 162 is preferably a fixed air orifice with its size determined by setting CO/CO2 limits during combustion testing at overfire. An exhaust conduit 170 has an inlet communicating with the blower outlet. The conduit 170 extends through the top wall 34 of the cabinet 14 and through the wall 172 of the building and has an outlet communicating with the atmosphere. The T-shaped conduit 158 mixes cool air with the flue exhaust so that relatively cool gases pass through the conduit 170. In an alternative construction (not shown), the T-shaped conduit 158 is replaced by an elbow (without the ambient air inlet 162), and the flue 114 has therein openings above the shelf 38 for admitting ambient air to cool the flue gases.

An air inlet conduit 174 extends through the wall 172 of the building and has an inlet communicating with the atmosphere. The conduit 174 also extends through the top wall 34 and the shelf 38, and, as shown in FIGS. 1 and 3, has an outlet 176 communicating with the lower space 46 near the skirt ring 70. The placement of the outlet 176 near the skirt ring improves the supply of air to the burner 122. Otherwise, it is possible that the air would get sucked out through T-shaped conduit 158, thereby inhibiting combustion.

The apparatus 10 also comprises a pressure switch 178 connected to the blower 166 and to the gas valve 146 for closing the gas valve when the pressure in the blower 166 is below a set point. The pressure switch 178 is mounted on top of the shelf 38. In general, all of the components mounted above the shelf 38 are strategically positioned to facilitate servicing of the apparatus. A water pump 182 is also mounted on top of the shelf 38. The pump 182 has (see FIG. 3) an inlet 184 communicating with the hydronic water chamber 118 via an air bleed valve 186 and the hydronic water outlet 98 of the tank 78. The pump 182 has an outlet 188 communicating with the header plate connection 66 via a hydronic water outlet conduit 190.

A pressure relief conduit 194 communicates between the expansion tank outlet 102 of the tank and the header plate connection 62. The pressure relief conduit 194 has therein a pressure relief valve 198 and communicates with an expansion tank 202 mounted above the shelf 38. A hydronic water inlet conduit 206 communicates between the header plate connection 65 and the hydronic water chamber 118 via the hydronic water inlet 94 of the tank 78. The hydronic water inlet conduit 206 has therein (see FIGS. 1 and 2) a gate valve 210 for opening and closing the hydronic water inlet conduit near the hydronic water inlet 94 of the tank 78.

An auto-fill valve 214 has (see FIG. 2) an outlet 216 communicating with the hydronic water inlet conduit 206 between the gate valve 210 and the header plate connection 65. The auto-fill valve 214 has an inlet 217 communicating with the header plate connection 63 via a conduit 218 so that the auto-fill valve 214 supplies additional water to the hydronic heating system when the pressure in the hydronic heating system is below a set point. Most hydronic systems experience a minor water loss due to evaporation or leakage at valve packings, pump seals, air vents, etc. To maintain system pressure the water must be replaced. An automatic fill valve is used for this. These valves are available from many companies.

The apparatus 10 also comprises (see FIG. 4) a potable water conduit 220 coiled around the flue 114 within the hydronic water chamber 118. The coiled potable water conduit 220 has an inlet end 222 extending through the potable water inlet 86 of the tank 78 and has an outlet end 226 extending through the potable water outlet 90 of the tank 78. A spacer 230 (FIG. 4) maintains the spacing of the coils of the conduit 220 during shipping. The spacer 230 is fixed to the flue 114 so as to maintain the position of the conduit 220 relative to the flue 114.

A conventional mixing valve 234 (see FIG. 2) has a cold water inlet 235 communicating with the header plate connection 63 via a branch of the conduit 218, a cold water outlet 236 communicating with the coiled conduit inlet end 222 via a cold water conduit 238, a hot water inlet 240 communicating with the coiled conduit outlet end 226 via a hot water conduit 241 (FIG. 1), and a mixed hot and cold water outlet 242 communicating with the header plate connection 64 via a conduit 244. In alternative embodiments of the invention the mixing valve can be omitted.

Figure 6:
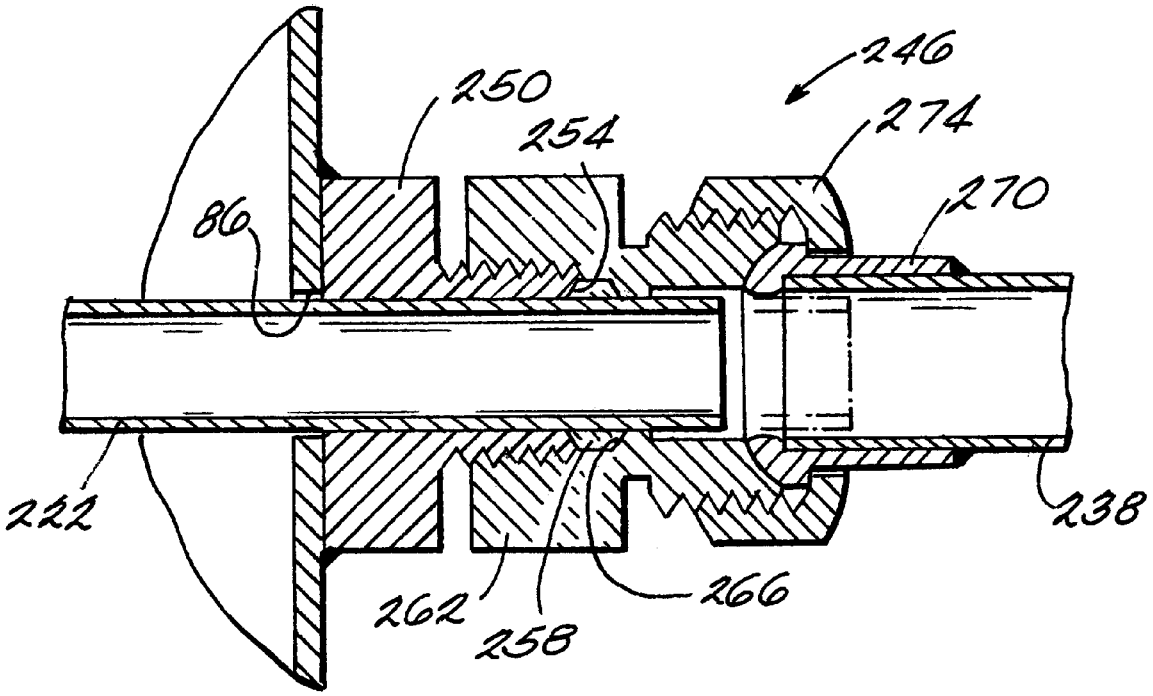
FIG. 6 is a sectional view of a special union.

As shown in FIG. 6, a special union 246 connects the cold water conduit 238 with the coiled conduit inlet end 222. The special union 246 includes an externally threaded spud 250 mounted on the exterior of the tank 78 over the potable water inlet 86 of the tank. The spud 250 has an outer end with an internal chamfer 254. The coiled conduit inlet end 222 extends through the spud 250. The special union 246 also includes a ferrule 258 surrounding the coiled conduit inlet end 222, and a union member 262 having an inner portion which is threaded onto the spud 250, which surrounds the ferrule 258 and which has an internal chamfer 266. The ferrule 258 is compressed between the chamfers 254 and 266 so that the ferrule 258 seals around the coiled conduit inlet end 222 and seals against both the spud 250 and the union member 262, thereby sealing the coiled conduit inlet end 222 relative to the tank 78. The union member 262 also has an outer portion to which the cold water conduit 238 is sealingly connected by a fitting 270 and a cap nut 274. This sealingly connects the cold water conduit 238 to the coiled conduit inlet end 222. The cold water conduit 238 has an inner diameter greater than the outer diameter of the coiled conduit inlet end 222 so that the coiled conduit inlet end can extend into the cold water conduit 238 (as shown in phantom in FIG. 6) if the coiled conduit inlet end 222 extends beyond the union member 262. A substantially identical special union 246 (FIG. 4) connects the hot water conduit 241 with the coiled conduit outlet end 226.

The auto-fill valve 214 is a pressure regulator with a bypass valve. Under normal system operation, if there is a leak in the hydronic system the valve will maintain a substantially constant pressure in the system. The valve 214 also has a setting to bypass the pressure regulator of the valve so that it allows the system to be filled quickly. When the tank is empty and the water is first turned on, because there is atmospheric pressure in the tank chamber 118 and inside the hydronic circuit, the auto-fill valve 214 will allow water to enter the system. When the system is turned on, the tank chamber 118 begins to fill and air escapes upstream of the pump 182 through the air bleed valve 186. When the water reaches the top of the tank the water level raises a float and shuts the air bleed valve 182. The tank is now full. The pressure relief valve 198 will dump water if the water exceeds its setpoint, usually 30 psi. This could be caused by excessive water temperature or water pressure with the autofill valve in the fast-fill or bypass mode.

There is usually, however, a significant amount of trapped air in the heating circuit in the radiators (shown schematically and represented by numeral 300 in FIG. 1). This trapped air creates an air-lock which will prevent the water from entering the system. The air bleeds on the radiators can be opened, but the water coming in the auto-fill valve 214 wants to take the path of least resistance, i.e. the water will want to go into the tank and out through the pressure relief valve 186 instead of going backwards through the hydronic system. The water comes up through the tank and, instead of going out through the pump 182 and flushing the air through the system in the other direction, the water exits from the pressure relief valve 198.

The gate valve 210 solves this problem. With the gate valve 210 in between the auto-fill valve 214 and the tank 78, the gate valve 210 is directly attached to the tank and then, on the other side of the gate valve, to the auto-fill valve 214. The hydronic water inlet conduit 206 is teed in between auto-fill valve 214 and gate valve 210. Once the tank is full and the air is completely bled out of the tank, then the gate valve 210 is closed. This prevents water from going into the tank through the hydronic water inlet conduit 206 and taking the path of least resistance and going out the pressure relief valve 198. The water now must flow through the radiator system, and the water pushes most or all of the air backwards through the heating system and back in through the pump 182 where the air hits the air bleed valve 186 which is plumbed at the very highest point in the system. This evacuates enough air to eliminate a vapor lock in the system. The pump 182 will circulate water and any additional air will bleed out through the air bleed valve 186.

Two on-off switches 304 and 308 (see FIGS. 3, 7 and 10) are located on the panel 56. The switch 304 controls power to the apparatus 10. When the switch 304 is on, the water heater will operate for potable water heating. The switch 308 operates the hydronic system. When the switches 304 and 308 are on, the pump 182 will operate when the thermostat calls for heat. The switches are preferably lighted when on. An indicator lamp 312 is also located on the panel 56 and indicates burner operation.

Various features of the invention are set forth in the following claims.

What is claimed is:

1. A combined potable water heater and hydronic heating system comprising:

a cabinet with an upper space and a lower space;

a water tank for holding water;

a flue extending through the tank;

a conduit mounted in the upper space of the cabinet, the conduit having a flue exhaust inlet communicating with the upper end of the flue, an ambient air inlet communicating with the upper space, and a mixed flue exhaust/ambient air outlet;

a burner below the flue so that heat and exhaust gases generated by the burner pass through the flue to heat the water in the tank;

a water container mounted in the tank so that the water in the tank heats the water in the water container and so that the water in the tank is separated from the water in the water container.

2. A system as set forth in claim 1 and further comprising a skirt ring fixed generally to the center of the base, the skirt ring having therein air inlet openings, and wherein the burner is located inside the skirt ring.

3. A system as set forth in claim 2 wherein the water tank is seated on top of the skirt ring so as to define a burner space below the tank and inside the skirt ring.

4. A combined potable water heater and hydronic heating system comprising:

a water tank for holding water;

a flue extending through the tank;

a burner below the flue so that heat and exhaust gases generated by the burner pass through the flue to heat the water in the tank;

a water container mounted in the tank so that the water in the tank heats the water in the water container and so that the water in the tank is separated from the water in the container; and a cabinet in which the water tank is mounted;

wherein the cabinet includes a generally vertical rear wall, generally parallel, generally vertical side walls extending forward from the opposite sides of the rear wall, a generally horizontal base extending forward from the bottom of the rear wall and between the side walls, a generally horizontal top wall extending forward from the top of the rear wall and between the side walls, a generally horizontal shelf extending forward from the rear wall and between the side walls so as to define an upper space between the shelf and the top wall and a lower space between the shelf and the base, a removable upper door for closing the front of the upper space, and a removable lower door for closing the front of the lower space, and wherein the water tank is located in the lower space.

5. A system as set forth in claim 4 and further comprising a generally vertical header plate fixed to the base inside the rear wall of the cabinet, the header plate including first, second, third, fourth, fifth and sixth water or gas connections extending through the rear wall of the cabinet, the first connection being connectable to a source of gas, the second connection being a pressure relief outlet, the third connection being an inlet for potable water, the fourth connection being an outlet for potable water, the fifth connection being an inlet for hydronic heating water, and the sixth connection being an outlet for hydronic heating water.

6. A system as set forth in claim 4 wherein the flue extends through the shelf so that the upper end of the flue is positioned by the shelf.

7. A system as set forth in claim 4 and further comprising a T-shaped conduit mounted on the upper end of the flue above the shelf, the T-shaped conduit having a flue exhaust inlet communicating with the upper end of the flue, an ambient air inlet communicating with the upper space, and a mixed flue exhaust/ambient air outlet.

8. A system as set forth in claim 7 and further comprising a blower having an inlet communicating with the mixed flue exhaust/ambient air outlet of the T-shaped conduit, and an exhaust conduit having an inlet communicating with the blower outlet, extending through the top wall of the cabinet, and having an outlet communicable with the atmosphere.

9. A system as set forth in claim 8 and further comprising a gas conduit having an outlet end communicating with the burner, wherein the gas conduit has an inlet end communicating with a source of gas via a gas valve, and further comprising a pressure switch connected to the blower to sense blower operation and connected to the gas valve for closing the gas valve when the pressure in the blower is below a set point.

10. A system as set forth in claim 4 and further comprising an air inlet conduit having an inlet communicable with the atmosphere, extending through the top wall and the shelf, and having an outlet communicating with the lower space near the burner.

11. A system as set forth in claim 4 and further comprising a water pump mounted on top of the shelf, the pump having an inlet communicating with the water tank via an air bleed valve.

12. A system as set forth in claim 1 wherein the potable water container is a heat exchanger.

13. A system as set forth in claim 12 wherein the heat exchanger includes a coiled conduit surrounding the flue.

14. A system as set forth in claim 13 and further comprising a spacer for maintaining the spacing of the coils of the coiled conduit during shipping, the spacer being fixed to the flue.

15. A system as set forth in claim 13 and further comprising a mixing valve having a cold water inlet communicating with a source of water, having a cold water outlet communicating with the coiled conduit inlet end via a cold water conduit, having a hot water inlet communicating with the coiled conduit outlet end via a hot water conduit, and having a mixed hot and cold water outlet.

16. A combined potable water heater and hydronic heating system comprising:

a water tank for holding water;

a flue extending through the tank;

a burner below the flue so that heat and exhaust gases generated by the burner pass through the flue to heat the water in the tank;

a water container mounted in the tank so that the water in the tank heats the water in the water container and so that the water in the tank is separated from the water in the container, wherein the water container is a heat exchanger which includes a coiled conduit surrounding the flue;

a mixing valve having a cold water inlet communicating with a source of water, having a cold water outlet communicating with the coiled conduit inlet end via a cold water conduit, having a hot water inlet communicating with the coiled conduit outlet end via a hot water conduit, and having a mixed hot and cold water outlet; and a special union connecting either the cold water conduit or the hot water conduit with the coiled conduit inlet end or the coiled conduit outlet end, respectively, the special union including an externally threaded spud mounted on the exterior of the tank, the spud having an outer end with an internal chamfer, the coiled conduit end extending through the spud, the special union also including a ferrule surrounding the coiled conduit end, and a union member having an inner portion which is threaded onto the spud, which surrounds the ferrule and which has an internal chamfer, the ferrule being compressed between the chamfers so that the ferrule seals around the coiled conduit end and seals against both the spud and the union member, thereby sealing the coiled conduit end relative to the tank, the union member also having an outer portion to which the water conduit is sealingly connected, thereby sealingly connecting the water conduit to the coiled conduit end, the cold water conduit having an inner diameter greater than the outer diameter of the coiled conduit end so that the coiled conduit end can extend into the water conduit if the coiled conduit end extends beyond the union member.

17. A system as set forth in claim 1 wherein the tank includes a potable water inlet, a potable water outlet, a hydronic water inlet, a hydronic water outlet, an expansion tank outlet, and a drain valve outlet.

18. A system as set forth in claim 1 and further comprising a baffle in the flue.

19. A combined potable water heater and hydronic heating system comprising:

a water tank for holding water;

a flue extending through the tank;

a water container mounted in the tank so that the water in the tank heats the water in the water container and so that the water in the tank is separated from the water in the water container; and a burner below the flue so that heat and exhaust gases generated by the burner pass through the flue to heat the water in the tank, wherein the burner has a generally cylindrical portion centered on the center axis of the flue, the cylindrical portion having an interior space, the burner also having a frustoconical portion above the cylindrical portion, the frustoconical portion having therein a plurality of outwardly and upwardly angled holes communicating between the interior space and the outer surface of the frustoconical portion, the holes being evenly spaced around the frustoconical portion with a gap between holes at every ninety degrees.

20. A system as set forth in claim 19 and further comprising a gas conduit having an outlet end communicating with the burner, the gas conduit being fixed relative to the tank so as to fix the burner relative to the flue.

21. A system as set forth in claim 1 wherein the tank has a hydronic water inlet, and further comprising a gate valve communicating with the hydronic water inlet.

22. A system as set forth in claim 21 and further comprising an auto-fill valve having an outlet communicating with the hydronic water inlet, the autofill valve having an inlet communicating with a source of water so that the auto-fill valve supplies additional water to the system when the pressure in the hydronic heating system is below a set point.

23. A water heater comprising:

a water tank;

a flue extending through the tank;

a burner below the flue so that heat and exhaust gases generated by the burner pass through the flue to heat the water in the tank;

a coiled heat exchanger and water conduit surrounding the flue so that the water in the tank heats the water in the heat exchanger, the heat exchanger having coils; and a spacer for maintaining the spacing of the coils during shipping, the spacer being fixed to the flue so as to resist movement of the coils relative to the flue during shipping.

24. A water heater comprising:

a water tank;

an external conduit with an end;

an internal conduit inside the tank, the internal conduit having an outer diameter less than the inner diameter of the external conduit; and a special union including an externally threaded spud mounted on the exterior of the tank, the spud having an outer end with an internal chamfer, so that the internal conduit end extends through the spud, a ferrule surrounding the internal conduit end, and a union member having an inner portion which is threaded onto the spud, which surrounds the ferrule and which has an internal chamfer, the ferrule being compressed between the chamfers so that the ferrule seals around the internal conduit end and seals against both the spud and the union member, thereby sealing the internal, conduit end relative to the tank, the union member also having an outer portion to which the external conduit is sealingly connected, thereby sealingly connecting the external conduit to the internal conduit end, so that the internal conduit end can extend into the external conduit if the internal conduit end extends beyond the union member.

25. A combined potable water heater and hydronic heating system comprising a cabinet including a generally vertical rear wall, generally parallel, generally vertical side walls extending forward from the opposite sides of the rear wall, a generally horizontal base extending forward from the bottom of the rear wall and between the side walls, a generally horizontal top wall extending forward from the top of the rear wall and between the side walls, a generally horizontal shelf extending forward from the rear wall and between the side walls so as to define an upper space between the shelf and the top wall and a lower space between the shelf and the base, a removable upper door for closing the front of the upper space, and a removable lower door for closing the front of the lower space, a generally vertical header plate fixed to the base inside the rear wall of the cabinet, the header plate including first, second, third, fourth, fifth and sixth water or gas connections extending through the rear wall of the cabinet, the first connection being connectable to a source of gas, the second connection being a pressure relief outlet, the third connection being an inlet for potable water, the fourth connection being an outlet for potable water, the fifth connection being an inlet for hydronic heating water, and the sixth connection being an outlet for hydronic heating water, a skirt ring fixed generally to the center of the base, the skirt ring having therein air inlet openings, a water tank seated on top of the skirt ring so as to define a burner space below the tank and inside the skirt ring, the tank including a potable water inlet, a potable water outlet, a hydronic water inlet, a hydronic water outlet, an expansion tank outlet, and a drain valve outlet, a drain valve communicating with the drain valve outlet in the tank, a generally vertical, generally cylindrical flue extending through the tank so as to define a hydronic water chamber inside the tank and outside the flue, the flue extending through the shelf so that the upper end of the flue is positioned by the shelf, the lower end of the flue communicating with the burner space, a baffle in the flue, a burner located in the burner space below the lower end of the flue, the burner having a generally cylindrical portion centered on the center axis of the flue, the cylindrical portion having an interior space, the burner also having a frustoconical portion above the cylindrical portion, the frustoconical portion having therein a plurality of outwardly and upwardly angled holes communicating between the interior space and the outer surface of the frustoconical portion, the holes being evenly spaced around the frustoconical portion with a gap between holes at every ninety degrees, the burner providing a flame that does not, when the burner is operating properly, impinge on any surface outside of the flue, a gas conduit having an outlet end communicating with the interior space of the burner, the gas conduit being fixed to the exterior of the tank so as to fix the burner relative to the tank and the flue, the gas conduit having an inlet end communicating with the source of gas via a gas valve and the first header plate connection, a thermostat which is mounted on the exterior of the tank and which is operably connected to the gas valve, a T-shaped conduit mounted on the upper end of the flue above the shelf, the T-shaped conduit having a flue exhaust inlet communicating with the upper end of the flue, an ambient air inlet communicating with the upper space, and a mixed flue exhaust/ambient air outlet, a blower having an inlet communicating with the mixed flue exhaust/ambient air outlet of the T-shaped conduit, and the blower having an outlet, an exhaust conduit having an inlet communicating with the blower outlet, extending through the top wall of the cabinet, and having an outlet communicable with the atmosphere, an air inlet conduit having an inlet communicable with the atmosphere, extending through the top wall and the shelf, and having an outlet communicating with the lower space near the skirt ring, a pressure switch connected to the blower and to the gas valve for closing the gas valve when the pressure in the blower is below a set point, a water pump mounted on top of the shelf, the pump having an inlet communicating with the hydronic water chamber via an air bleed valve and the hydronic water outlet of the tank, and the pump having an outlet communicating with the sixth header plate connection via a hydronic water outlet conduit, a pressure relief conduit communicating between the expansion tank outlet of the tank and the second header plate connection, the pressure relief conduit having therein a pressure relief valve and communicating with an expansion tank mounted above the shelf, a hydronic water inlet conduit communicating between the fifth header plate connection and the hydronic water chamber via the hydronic water inlet of the tank, the hydronic water inlet conduit having therein a gate valve for opening and closing the hydronic water inlet conduit near the hydronic water inlet of the tank, an auto-fill valve having an outlet communicating with the hydronic water inlet conduit between the gate valve and the fifth header plate connection, the autofill valve having an inlet communicating with the third header plate connection so that the auto-fill valve supplies additional water to the hydronic heating system when the pressure in the hydronic heating system is below a set point, a coiled potable water conduit coiled around the flue within the hydronic water chamber, the coiled potable water conduit having an inlet end extending through the potable water inlet of the tank and having an outlet end extending through the potable water outlet of the tank, a spacer for maintaining the spacing of the coils of the coiled conduit during shipping, the spacer being fixed to the flue, a mixing valve having a cold water inlet communicating with the third header plate connection, having a cold water outlet communicating with the coiled conduit inlet end via a cold water conduit, having a hot water inlet communicating with the coiled conduit outlet end via a hot water conduit, and having a mixed hot and cold water outlet communicating with the fourth header plate connection, a special union connecting the cold water conduit with the coiled conduit inlet end, the special union including an externally threaded spud mounted on the exterior of the tank over the potable water inlet of the tank, the spud having an outer end with an internal chamfer, the coiled conduit inlet end extending through the spud, the special union also including a ferrule surrounding the coiled conduit inlet end, and a union member having an inner portion which is threaded onto the spud, which surrounds the ferrule and which has an internal chamfer, the ferrule being compressed between the chamfers so that the ferrule seals around the coiled conduit inlet end and seals against both the spud and the union member, thereby sealing the coiled conduit inlet end relative to the tank, the union member also having an outer portion to which the cold water conduit is sealingly connected, thereby sealingly connecting the cold water conduit to the coiled conduit inlet end, the cold water conduit having an inner diameter greater than the outer diameter of the coiled conduit inlet end so that the coiled conduit inlet end can extend into the cold water conduit if the coiled conduit inlet end extends beyond the union member, and a second special union connecting the hot water conduit with the coiled conduit outlet end, the second special union including an externally threaded second spud mounted on the exterior of the tank over the potable water outlet of the tank, the second spud having an outer end with an internal chamfer, the coiled conduit outlet end extending through the second spud, the second special union also including a second ferrule surrounding the coiled conduit outlet end, and a second union member having an inner portion which is threaded onto the second spud, which surrounds the second ferrule and which has an internal chamfer, the second ferrule being compressed between the chamfers of the second spud and the second union member so that the second ferrule seals around the coiled conduit outlet end and seals against both the second spud and the second union member, thereby sealing the coiled conduit, outlet end relative to the tank, the second union member also having an outer portion to which the hot water conduit is sealingly connected, thereby sealingly connecting the hot water conduit to the coiled conduit outlet end, the hot water conduit having an inner diameter greater than the outer diameter of the coiled conduit outlet end so that the coiled conduit outlet end can extend into the hot water conduit if the coiled conduit outlet end extends beyond the second union member.

26. A system as set forth in claim 23 wherein the tank contains hydronic heating water and the coiled heat exchanger contains potable water.

27. A combined potable water heater and hydronic heating system as set forth in claim 1 wherein the water tank holds hydronic heating water and the water container holds potable water.

28. A combined potable water heater and hydronic heating system as set forth in claim 4 wherein the water tank holds hydronic heating water and the water container holds potable water.

29. A combined potable water heater and hydronic heating system as set forth in claim 16 wherein the water tank holds hydronic heating water and the water container holds potable water.

30. A combined potable water heater and hydronic heating system as set forth in claim 19 wherein the water tank holds hydronic heating water and the water container holds potable water.

31. A combined potable water heater and hydronic heating system as set forth in claim 1 and further comprising a generally horizontal shelf dividing the cabinet into the upper and lower spaces.

* * * * *

UNITED STATES PATENT AND TRADEMARK OFFICE

CERTIFICATE OF CORRECTION

PATENT NO. : 6,202,935 B1
DATED : March 20, 2001
INVENTOR(S) : Marc W. Akkala et al It is certified that error appears in the above-identified patent and that said Letters Patent is hereby corrected as shown below:

Column 8,
Line 8, delete "claim 1" and insert -- claim 4 --.

Signed and Sealed this

Fifth Day of November, 2002

*Attest:*

*Attesting Officer*

JAMES E. ROGAN
*Director of the United States Patent and Trademark Office*